US005456573A

United States Patent [19]

Morris et al.

[11] Patent Number: 5,456,573

[45] Date of Patent: Oct. 10, 1995

[54] STACKER SLIDE

[75] Inventors: Jeffrey J. Morris, Parkton; Robert M. Swec, Baltimore, both of Md.; Leslie P. Lazzeri, York, Pa.; Robert S. Frantz, Phoenix, Md.; August A. Zachmeier, Joppa, Md.; Horace W. Weeks, Towson, Md.

[73] Assignee: Duchossois Industries, Inc., Elmhurst, Ill.

[21] Appl. No.: 113,919

[22] Filed: Aug. 31, 1993

[51] Int. Cl.[6] ..... B65G 57/03

[52] U.S. Cl. ..... 414/789.9; 414/788.8; 414/790; 271/217; 271/3.09

[58] Field of Search ..... 414/788.8, 789.9, 414/790; 271/3.1, 214, 215, 217

[56] References Cited

U.S. PATENT DOCUMENTS

| | | | |
|---|---|---|---|
| 1,693,928 | 12/1928 | Labombarde | 271/3.1 |
| 4,051,957 | 10/1977 | Parups | 271/217 |
| 4,423,995 | 1/1984 | Karis | 271/217 |
| 4,440,386 | 4/1984 | Achelpohl | 271/217 |
| 4,524,965 | 6/1985 | Kulpa | 271/214 |
| 4,966,521 | 10/1990 | Frye et al. | 271/3.1 |
| 5,190,281 | 3/1993 | Cardenas | 271/217 |

*Primary Examiner*—Michael S. Huppert
*Assistant Examiner*—Gregory A. Morse
*Attorney, Agent, or Firm*—Lowe, Price, LeBlanc & Becker

[57] ABSTRACT

An improved stacker for an automatic document sorter is described. The stacker is vertical and receives documents at the top thereof and expels them at the bottom. The stacker includes a paddle normally disposed at the top for receiving the first document and subsequent documents stacked thereon. As documents enter the stacker, the paddle drops due to the action of a timing belt and sensor arrangement until it reaches the bottom. At the bottom, a horizontally directed timing belt withdraws the paddle from the stacker and the paddle is then returned by reverse action to the top of the stacker and reinserted thereinto for receiving the next stack of documents. Both timing belts are independently driven by motors.

4 Claims, 3 Drawing Sheets

STACKER SLIDE

TECHNICAL FIELD

This invention relates to a mechanical device for use in a document sorter and in particular to a stacker slide mechanism for a document stacker wherein documents are fed from the top into a stacker and emptied from the bottom. The slide mechanism includes a paddle which is articulated to move both vertically and horizontally.

BACKGROUND ART

In the field of document sorting, and in particular in relation to sorting mail pieces, there has been a need for an automatic sorter which will rapidly and efficiently sort mail pieces regardless of size and thickness whereby an individual mail carrier may sort his entire route by house number or doorway in a matter of minutes. This type of machine is capable of sorting, for example, three thousand pieces of mail in this fashion. Such a machine is described in copending U.S. patent application Ser. No. 07/961,980 filed Oct. 16, 1992, now U.S. Pat. No. 5,363,971 the disclosure of which is hereby incorporated by reference, and assigned to the U.S. Postal Service.

In that machine a plurality of vertical stackers are provided. The vertical stackers are fed by belts with individual mail pieces. The mail pieces are sequentially sorted so that in three passes through the device the random distribution of, for example, three thousand mail pieces will be sorted sequentially according to the carrier's route addresses. During the three passes each of the individual stackers is filled from the top and then emptied from the bottom. The roughly one thousand pieces of mail then are distributed preferably in 12 or 13 stackers which fill and empty three times in order to sequence the mail stream.

The stackers then are twenty-eight inches high and when fed from the top must permit the stacking of mail pieces on their flat surfaces and not on the edges. In order to achieve this, a paddle is disposed adjacent the top of the stacker, initially, and as mail pieces are fed into the stacker they rest on top of the paddle which lowers as the mail pieces accumulate. When the paddle reaches the bottom, it translates out from under the stack and returns to the top to receive mail sorted in the next pass. The stack is then emptied sequentially from the bottom for a subsequent round of sorting to fill the stacker again from the top. The paddle accordingly must translate vertically downwardly, horizontally to be withdrawn from the stack, vertically upwardly, and then horizontally into the stack. These motions must be smooth and achievable fairly rapidly as the entire machine will sort the three thousand pieces of mail in three passes within minutes.

Articulation of the paddle could be achieved with a linear actuator such as a ball screw device. In a ball screw device, a shaft which is threaded turns and an internally threaded ball nut or block mounted thereon supports the paddle. Therefore, movement of the ball nut or block vertically on one shaft and horizontally on a separate shaft would achieve the necessary articulation.

The ball screw type device in addition to being noisy, expensive and bulky, has a disadvantage in that it must be kept clean. If dirt accumulates in the threads, the device can jam which would require dismantling and cleaning. Accordingly, it was proposed to supply a separate bellows adjacent the threaded shaft to keep the dust from accumulating in the threads. This of course adds additional cost and an additional feature to the machine which itself could be subject to breakdown.

SUMMARY OF THE INVENTION

It has been discovered, however, that the support paddle in the vertical stacker of the document sorting machine can be articulated by the use of horizontal and vertical timing belts. The timing belts supply both a self cleaning drive and a smooth motion. The belts can be then driven externally to vertically raise or lower the paddle and to horizontally withdraw or insert the paddle into the stack. The timing belt design of this invention then provides both a reliable and efficient means for articulating the paddle but also a substantially error free, breakdown free means which also is relatively quiet to operate.

Accordingly, it is an object of this invention to provide an improved stacker slide articulating mechanism for a document sorting machine which will rapidly and efficiently raise, lower and insert and withdraw the paddle support from each stacker.

It is another object of this invention to provide horizontal and vertically operable timing belts to articulate a stacker slide both vertically and horizontally which will be self cleaning, require no lubrication, and relatively quiet to operate.

It is a further object of this invention to provide an efficient means for stacking documents in a vertical stacker which fills from the top and empties from the bottom for repeated operations which articulating mechanism will be self cleaning and relatively quiet to operate. These and other objects will become readily apparent with reference to the drawings and following description.

DETAILED DESCRIPTION OF THE INVENTION

Figure 1:
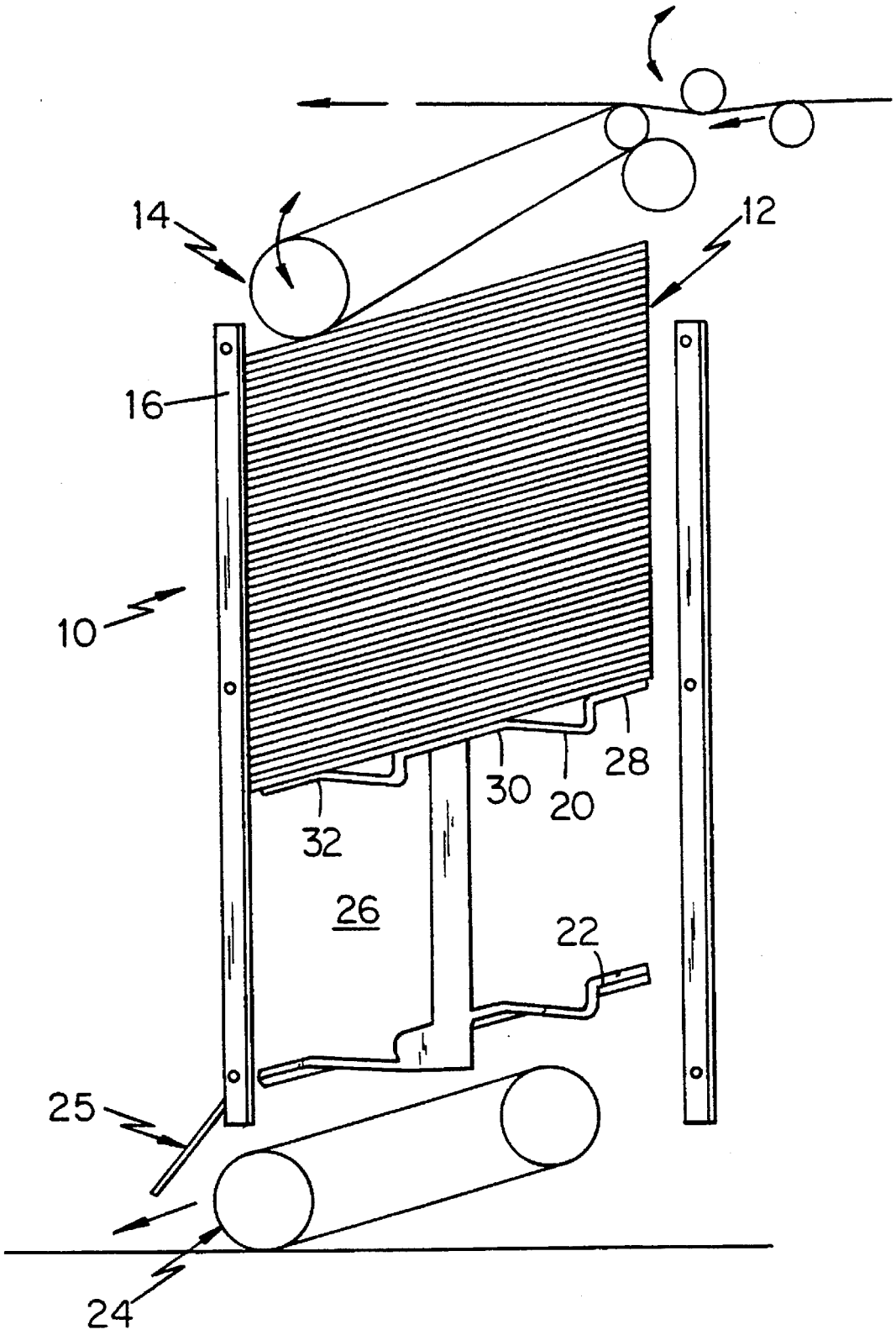
FIG. 1 is a schematic representation of a vertical stacker and slide for a document sorter.
Figure 4:
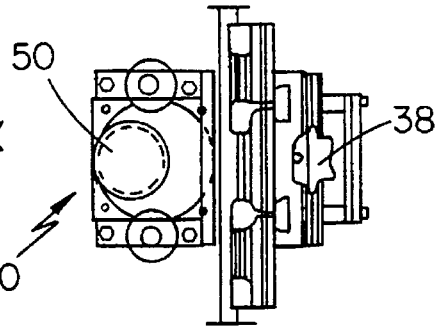
FIG. 4 is a cross sectional view taken along lines 4—4 of FIG. 2.

With attention to FIG. 1, there is shown a typical stacker 10 having a plurality of mail pieces 12 stacked therein. As an individual mail piece enters the stack 12, it comes into contact with a stacker pulley 14 which rests on top of the stack 12. The stacker pulley 14 contains at least one friction wheel which assists the mail piece across the top of the stack and over to the forward stacker wall 16, providing proper edging.

The stacker pulley 14 is spring loaded and exerts a slight pressure on top of the stack. As mail enters the stacker, the stacker pulley 34 rises slightly. A proximity sensor (not shown) detects this rise after it reaches a predetermined threshold and signals a microprocessor (also not shown) to lower the paddle 20. The paddle 20 is attached to a motor (not shown) controlled mechanism which will be subsequently explained which is capable of moving the paddle 20 through all of its required motions. When the paddle 20 is lowered, the stacker pulley 14 is also lowered along with it to the point that the sensor is deactivated. When the sensor is deactivated, the paddle stops. In this way, a relatively constant pressure is maintained by the stacker pulley 14 on the mail stack. This is critical for proper stacking.

As mail enters the stacker, the mail stack grows downward toward the bottom of the stacker. When the pass is completed, the paddle 20 is lowered to the bottom of the stacker and is retracted through a slot 22 in the lower portion of the stacker. When the paddle is retracted, the mail stack on top of the paddle is deposited onto the shingler belt 24 at the bottom of the stacker. The paddle 20 is then raised to the top of the stacker from behind the base plate 26 extended through another slot (not shown) in the top of the base plate 26 and redeposited directly beneath the stacker pulley 14. At this point, the next pass is ready to begin by shingling the mail out of the bottom of the stacker.

Figure 2:
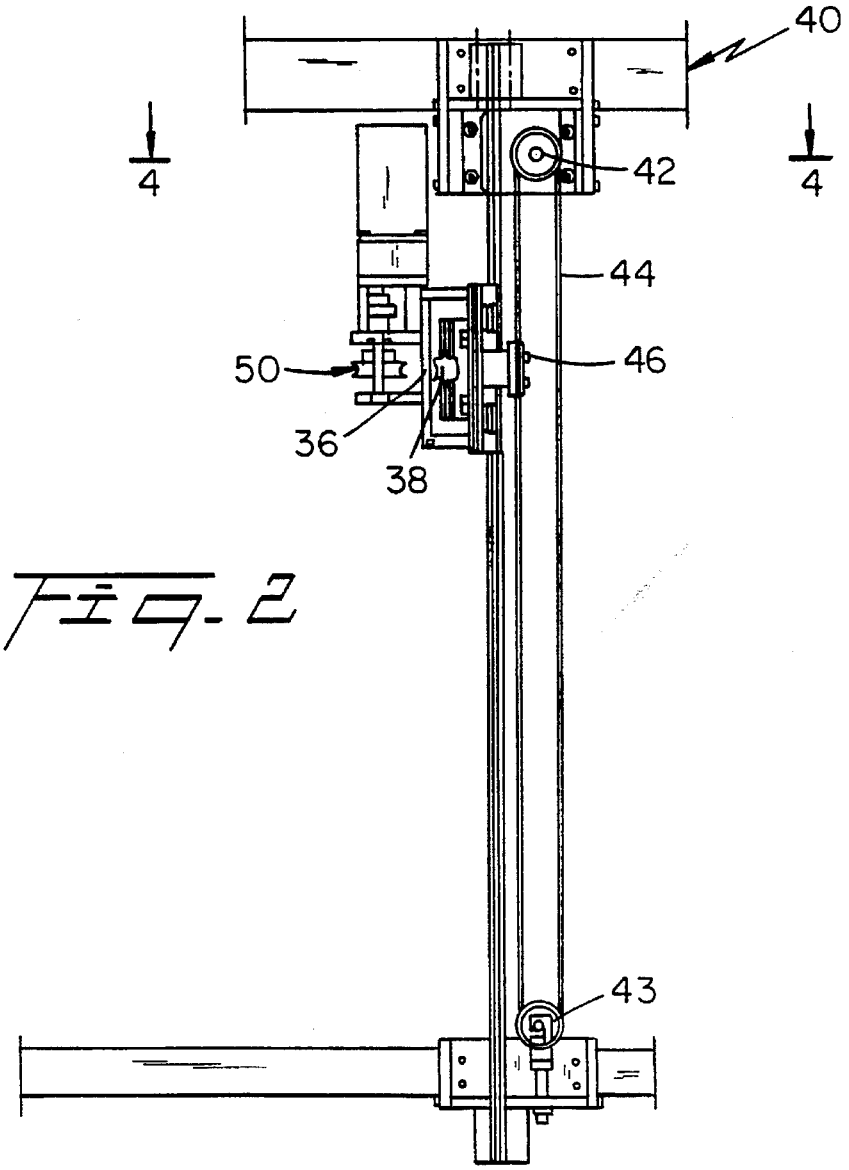
FIG. 2 is a front view of the articulating mechanism of this invention.

The paddle 20 is designed so that it can be retracted through the slot 22 in the base plate 26 without disturbing the stack and at the same time facilitate sweeping. The paddle has a zigzag design wherein 3 support plates 28, 30, and 32 are provided which are contained in a common plane disposed at an angle to the horizontal and parallel to the shingler belt 24. Between coplanar portions 28, 30, and 32 are substantially horizontal sections which are at angles which are not parallel to the angles contained in the supporting plates 28, 30, and 32. The slot 22 then conforms to the zigzag profile of the paddle so that the paddle can be retracted through the slot and will not carry with it any mail resting thereon. The portions of the slot 22 disposed between the coplanar portions 28, 30, and 32 block the exit of any mail from the stack with the paddle. As also is evident, the paddle design assists the operator in sweeping by providing a place for fingers when lifting the stack off of the paddle which corresponds to the angular sections between the coplanar supporting plates 28, 30, and 32. The shingled stream exits the bottom of the stacker 10 by the action of shingler belt 24 against plate 25 so that a shingled stream then is removed from the stack. With attention to FIGS. 2–5, and to FIGS. 2 and 3, in particular, FIG. 2 represents a view looking into the base plate or front plate 16 whereas FIG. 3 is a side view illustrating the plate 16, the slot 22, and the paddle 20.

Paddle 20 is supported by a horizontal arm 36 which, in turn, is slidably mounted on a vertical shaft 38. With attention to FIG. 2, a vertical drive system for arm 36 and paddle 22 is provided by a drive mechanism 40 mounted above shaft 38 which includes a drive wheel 42 and a vertical timing belt 44. Belt 44 at one side thereof mounts arm 36 at bracket 46 rigidly to belt 44. Rotation of drive wheel 42 in combination with idler 43 then drives the timing belt 44 which, in turn, raises or lowers the arm 36 by moving bracket 46 along shaft 38.

Figure 5:
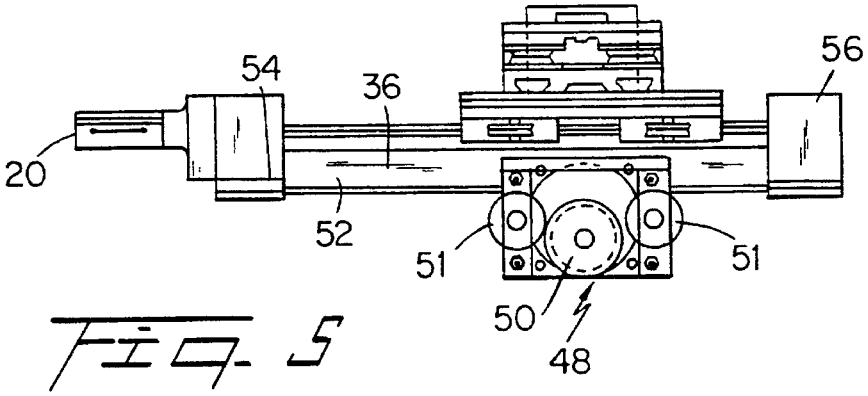
FIG. 5 is a cross sectional view taken along lines 5—5 of FIG. 3.
Figure 3:
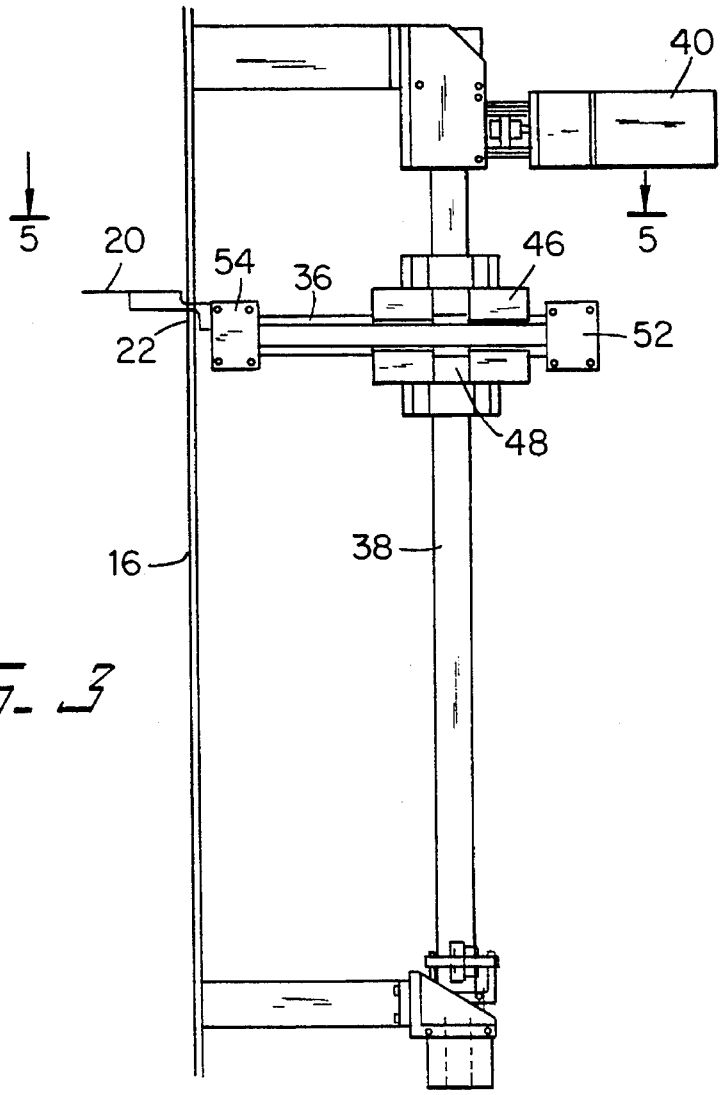
FIG. 3 is a side view of the articulating mechanism of FIG. 2.

Similarly, as shown in FIGS. 3 and 5, arm 36 is slidably received in bracket 46 and a drive mechanism 48 is provided therefor. Drive mechanism 48 includes drive wheel 50, tensioners 51 and a horizontal timing belt 52. Belt 52 extends between terminal blocks 54 and 56 on arm 36. Rotation then of drive wheel 50 will be translated into sliding movement of arm 36 relative to bracket 46 in a horizontal direction to withdraw or reinsert paddle 20 through stacker wall 16.

Accordingly, the articulation of paddle 20 can be rapidly and smoothly achieved by controlled rotation of timing belts 44 and 52.

In summary, there is described an articulating mechanism for a document stacker for use in an automatic sorting machine wherein a paddle is provided upon which documents entering the stacker rest as they accumulate vertically in the stacker. As documents enter the stacker, the paddle drops from the top down to the bottom until it reaches bottom. At this point, the paddle is articulated horizontally outwardly from the stacker allowing the documents stacked to rest upon a shingler for expelling the documents in a shingled stream from the bottom of the stacker. The paddle is then translated upwardly to the top and reenters the stacker at the top for receiving the next stack of documents. Both vertical and horizontal articulation is achieved by the use of timing belts and motors controlling the same which are, in turn, controlled by the microprocessor which controls the sorting machine. The paddle then drops in the stacker sequentially based upon a sensed input until the stacker reaches the bottom whereupon another sensor triggers the horizontal articulation which withdraws the paddle so that it may be returned to the top of the stacker. These motions are achieved by a self-cleaning, relatively quiet pair of timing belts which operate in the horizontal and vertical directions to achieve XY motion or articulation in a rapid and efficient fashion.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. In an automatic document sorter including a plurality of vertical stackers for receiving documents into the top thereof and for dispensing a shingled stream of said documents from the bottom thereof wherein a paddle is provided which is movable vertically and horizontally from a beginning position within the stacker adjacent the top thereof, when the stacker is empty, to a position adjacent the bottom thereof with a stack of documents resting thereon, whereupon said paddle is withdrawn from the stacker, translated vertically to the top thereof and reinserted into the top of said stacker in the beginning position, the improvement comprising:

a vertical shaft mounted adjacent the stacker; a block slidably mounted on said shaft; an arm extending horizontally, slidably received in said block, said arm mounting said paddle at an end thereof; first timing belt vertically extending along said shafts; first drive means coupled to said first belt and to said shaft for driving said belt, selectively forwardly or rearwardly; coupling means coupling said block to said first belt so that rotation thereof will raise or lower said block along said shaft; and second timing belt horizontally extending along said arm said second belt being affixed at either end thereof to opposite ends of said arm; second drive means coupled to said second belt and to said block for driving said belt, selectively forwardly or rearwardly; second coupling means coupling said second belt to said arm so that driving said belt will cause said arm to translate horizontally relative to said block.

2. The device of claim 1 wherein said first belt is continuous.

3. The device of claim 1 wherein said paddle has an upper document supporting surface with a plurality of coplanar sections disposed at an acute angle to the horizontal and intermediate substantially horizontal sections spaced therebetween to form a zigzag profile.

4. The device of claim 3 wherein said stacker includes a vertical wall perpendicular to said arm which includes a slot at the bottom thereof having a profile substantially identical to the zigzag profile of said paddle so that said paddle can be withdrawn therethrough.

* * * * *